US005809700A

United States Patent [19]

Roush et al.

[11] Patent Number: 5,809,700

[45] Date of Patent: Sep. 22, 1998

[54] GROUND ENGAGING RESTRAINT DEVICE

[75] Inventors: Warren H. Roush; Anne F. Roush, both of Dacula, Ga.; Jo Ellen Bradley, Grand Island, N.Y.

[73] Assignee: Anjowa, Inc., Dacula, Ga.

[21] Appl. No.: 848,531

[22] Filed: Apr. 28, 1997

Related U.S. Application Data

[63] Continuation-in-part of Ser. No. 641,742, May 2, 1996, abandoned.

[51] Int. Cl.[6] ..... E04D 1/34

[52] U.S. Cl. ..... 52/4; 52/23; 52/155; 52/102; 52/103; 52/165; 52/166; 135/117; 135/118; 135/119

[58] Field of Search ..... 248/508, 545, 248/500, 159, 499; 52/103, 102, 155, 156, 157, 158, 159, 165, 166, 23, 4; 135/117, 118, 119, 15

[56] References Cited

U.S. PATENT DOCUMENTS 4,852,834 8/1989 Hosman ..... 52/165 X

*Primary Examiner*—Carl D. Friedman
*Assistant Examiner*—W. Glenn Edwards
*Attorney, Agent, or Firm*—Hinkle & Associates, P.C.

[57] ABSTRACT

The ground engaging restraint device (2) comprises a ground spike (4) and a clasp (6). Comprising the clasp is a head (48), a pin (50) and a pair of arms (52) having teeth (64). The ground spike has a receiver (12) having a bore (20) and circumferential notches (24), an elongated shaft (16) having a ground-engaging stop (18). In one embodiment the shaft has a plurality of interconnected webs (36), and in another embodiment the shaft has a helical blade (72) fixed concentrically about the shaft. A portion of an article (14) is placed over and inserted into the bore by placing the clasp over the receiver, causing the pin to enter the bore and frictionally engage the article between the pin and the bore. Teeth of a pair of arms engage a plurality of notches (24) on the receiver, removably retaining the clasp on the receiver.

22 Claims, 3 Drawing Sheets

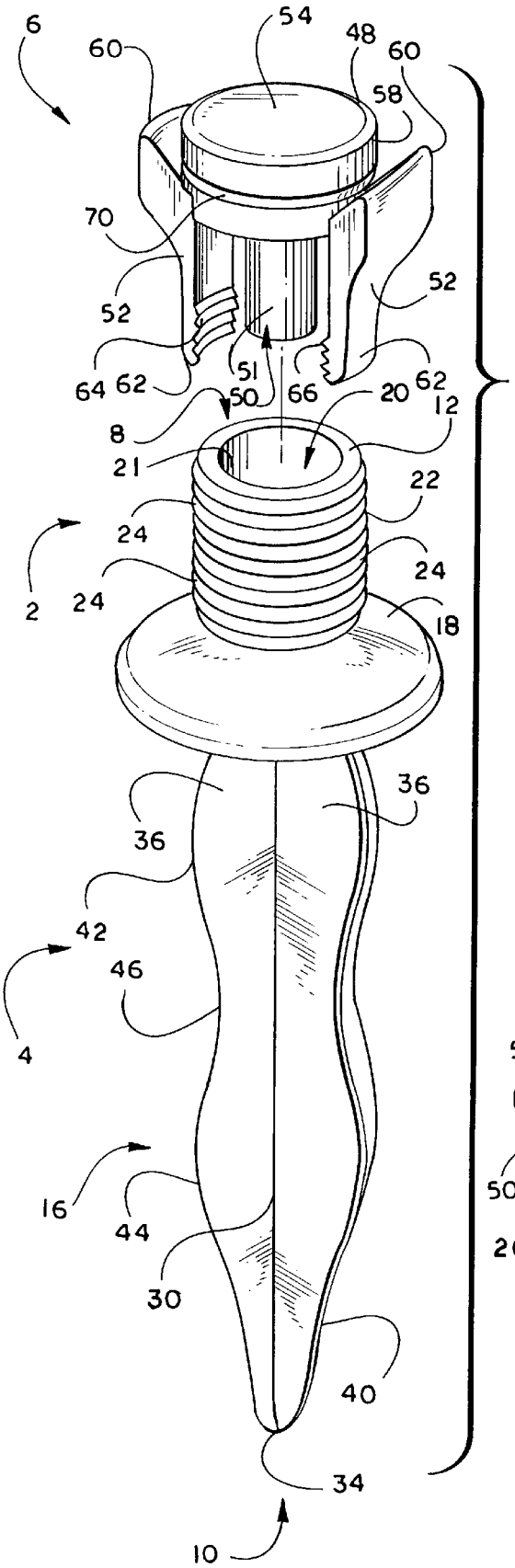
Fig_1
Fig_2
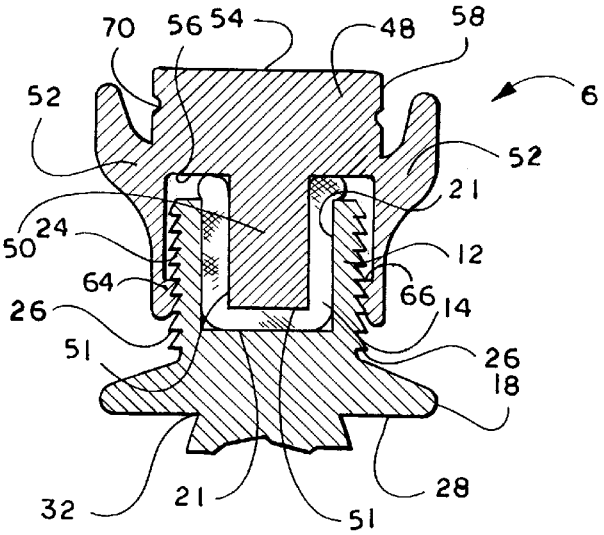

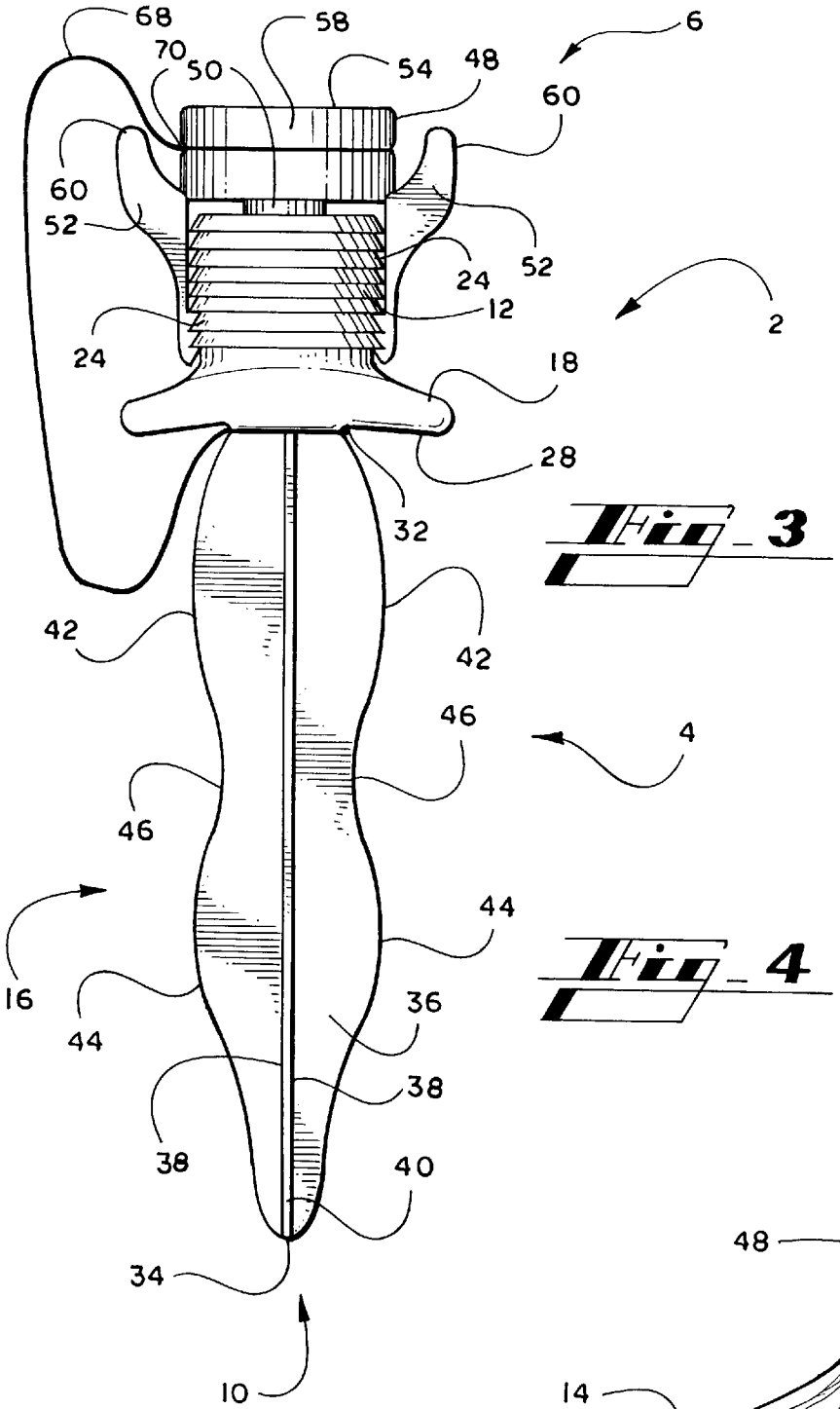
Fig. 3
Fig. 4
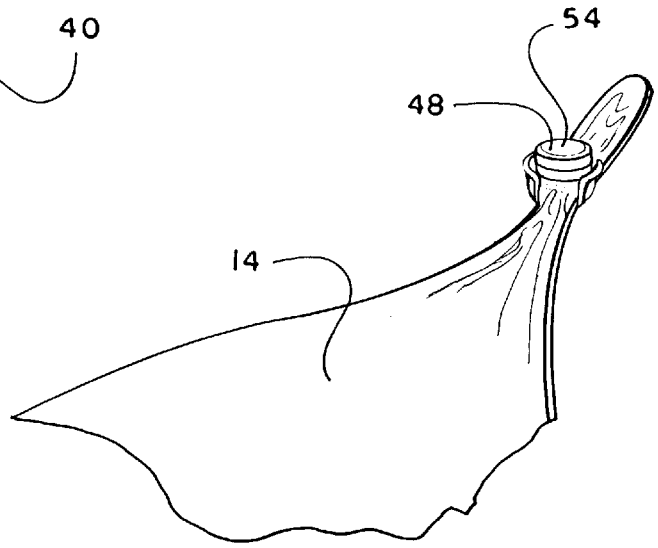

GROUND ENGAGING RESTRAINT DEVICE

RELATED PATENT DOCUMENTS

This is a continuation-in-part of U.S. application Ser. No. 08/641,742 filed May 2, 1996, by Warren H. Roush, Anne F. Roush and Jo Ellen Bradley entitled "Ground Engaging Restraint Device", now abandoned.

BACKGROUND OF THE INVENTION

I. Field of the Invention

The present invention relates generally to the field of ground anchoring devices. More particularly, the present invention relates to an apparatus for anchoring a towel, blanket, other like flexible materials and certain non-flexible items to the ground.

II. Description of the Related Art

Individuals often go to beach areas for relaxation and pleasure. Often, they bring items with them to enhance the experience, such as a sun block, a radio, handbags, and a beach blanket or towel. However, it is common for beaches to have consistent winds which are strong enough to move light items or roll the corners of the towel or blanket placed on the beach. In addition, stepping on the towel or blanket may cause the corners to likewise roll or the item to fold over. It has been a consistent problem to maintain the towel or blanket in a stretched, substantially stationary position on the beach.

In an attempt to keep the towel or blanket stationary, individuals have been known to place items, such as shoes, ice chests, sand bags and the like, on the corners as a weight. This technique is not always successful and useful space for the individual is wastefully occupied by the item. Also, this method is not convenient and does not provide a neat and attractive site on which the individual may relax.

In an attempt to overcome this problem, others have devised forms of stakes to hold the beach towel or blanket. These are typically inserted into the ground and have a portion that can destructively grip the towel or blanket. Although temporarily effective, these stakes can rip or tear fabric items during use.

Further, certain non-flexible material items also need anchoring, whether at the beach or in other areas. For instance, lawn furniture of light-weight construction is easily flown around and would benefit from this invention. One could anchor, or secure, ice chests, shoes and handbags to deter the unauthorized removal of these items. Even pets could be secured on a leash to the present invention.

Although not a stake for anchoring an item to the ground, there is disclosed in U.S. Pat. No. 4,185,424 a molded plastic stake having interconnecting webs. The stake has two ends and an intermediate point between the ends. Each web tapers from one end inwardly to the intermediate point. At the intermediate point, the webs extend outwardly to form a shoulder to resist pullout. From the shoulder, each web tapers inwardly to the other end of the stake and merges with the other webs.

A fabric-engaging stake described in U.S. Pat. No. 4,699,165 by Barzana has an elongated body with four ground-engaging, tapered vanes. The upper end is provided with a planar portion which has an arcuate slot and a vertical slot. Within the arcuate slot is a rotatable ring which engages a recess on the edge of the planar portion. The fabric, or other article which is to be held, is placed within the slot and over the edge of the planar portion. The ring is rotated over the fabric to engage the recess and to anchor the fabric to the stake. Once the recess is no longer capable of retaining the ring within the recess, the stake is incapable of holding the fabric to the stake.

U.S. Pat. No. 5,158,258 granted to McFadzean has a fabric holding device that is a generally flat-sided, elongated device with a ground-engaging lower part and a fabric-engaging upper part. The lower part has a tapered shape with protruding elements to resist removal from the ground. The upper part has opposing members with a slot. The members have protruding teeth within the slot to grip the fabric. As stress is placed upon the fabric, it is possible for the teeth to tear or damage the fabric.

A blanket anchor described in U.S. Pat. No. 5,176,354 by Feigenbaum, Jr. has a stake portion to engage the ground and a fabric-engaging head portion. The stake is a V-shaped, elongated member that is tapered longitudinally from the head portion to a free end of the stake. A convex surface on the head portion is provided for applying a driving force to insert the stake into the ground. The head portion is also provided with a clamp having teeth to engage the fabric. Similar to the fabric-engaging stake described above, as stress is placed upon the fabric, the teeth have an ability to tear or damage the fabric.

A Beach Blanket Retaining Device is disclosed in U.S. Pat. No. 5,390,890 issued to Ferguson et al. This device has a stake and a head screw threaded onto the stake. Ferguson does not teach or suggest utilizing a pivoting arm depending from the head to engage a notch on the stake to removably retain the head onto the stake.

Callaway in U.S. Pat. No. 5,564,232 discloses a Tarpaulin Holddown Device which is basically a stake with a handle designed to be inserted through a grommet of the tarpaulin and into the ground. The stake has an elongated cylindrical shaft with a point at one end and a stop at the other end. Between the stop and the point is a hole with is disposed through the shaft perpenduiclarly to the longitudinal axis of the stake. The hole receives a retaining pin. In use the stake is inserted through the grommet, a washer is then placed on the stake to sandwich the grommet between the stop and the washer, the retaining pin is inserted through the hole to lock the washer onto the shaft and the stake is inserted into the ground. The tarpaulin is not inserted through the hole and the retaining pin does not engage the tarpaulin. Further, this device does not teach or suggest placing the tarpaulin into a bore located at an end of a stake and utilizing a receiver with a depending pin to hold the tarpaulin in the bore by inserting the pin into the tarpaulin containing bore, creating frictional engagement.

SUMMARY OF THE INVENTION

In accordance with the present invention, the objectives of this invention are to provide:

- an anchoring device which has a clasp portion and a nail portion;
- a non-destructing means to keep an article, such as beach blanket, towel, or other like flexible material in a stretched, substantially stationary position on the ground and to keep a non-flexible, hardened article secure to the ground;
- a webbed shaft which resists movement within the soil;
- a helical blade fixed concentrically about a shaft to screw the shaft into the ground and resist movement within the soil;
- a stop having thumb surfaces disposed adjacent a shaft to assist in rotating the shaft into the ground;

a receiver and a pin which, in combination, resist movement of the article disposed between them;

a striking surface to drive the shaft into the ground;

a ground engaging restraint device made from resilient plastic; and a ground engaging restraint device which is inexpensive to fabricate and simple to use.

This invention accomplishes the above and other objectives and overcomes the disadvantages of the prior art by providing a ground engaging restraint device for anchoring an article that is simple in design and construction, inexpensive to fabricate, and easy to use. The ground engaging restraint device primarily comprises two portions, a clasp and a ground spike. Comprising the clasp is a head, a pin and a pair of arms having teeth. The ground spike has a receiver having a bore and circumferential notches, an elongated shaft and a ground engaging stop disposed intermediate the receiver and the shaft. In one embodiment the shaft has a plurality of interconnected webs having nadiers to resist removal from the ground once the shaft is inserted therein. Another embodiment has a shaft with a helical blade fixed concentrically about a shaft to screw the shaft into the ground. A portion of the article to be secured is placed over the bore and inserted within the bore by placing the clasp over the receiver, causing the pin to enter the bore and compress the article between the pin and the bore. The teeth of the arm engage the notches of the receiver, removably retaining the clasp on the receiver.

It is to be understood that the phraseology and terminology employed herein are for the purpose of description and should not be regarded as limiting. As such, those skilled in the art will appreciate that the conception, upon which this disclosure is based may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Other objects, advantages and capabilities of the invention will become apparent from the following description taken in conjunction with the accompanying drawings showing preferred embodiments of the invention.

BRIEF DESCRIPTION OF THE DRAWINGS

FIG. 1 is an exploded, side perspective view of an embodiment of a ground engaging restraint device made in accordance with the present invention;

FIG. 2 is a partial side section view taken along a longitudinal axis of the present invention showing the clasp anchoring the article within a receiver;

FIG. 3 is a side elevation view of the embodiment shown in FIG. 1 with a cord;

FIG. 4 is a partial perspective view of the apparatus engaging the ground and anchoring the article;.

DESCRIPTION OF THE PREFERRED EMBODIMENTS

Figure 5:
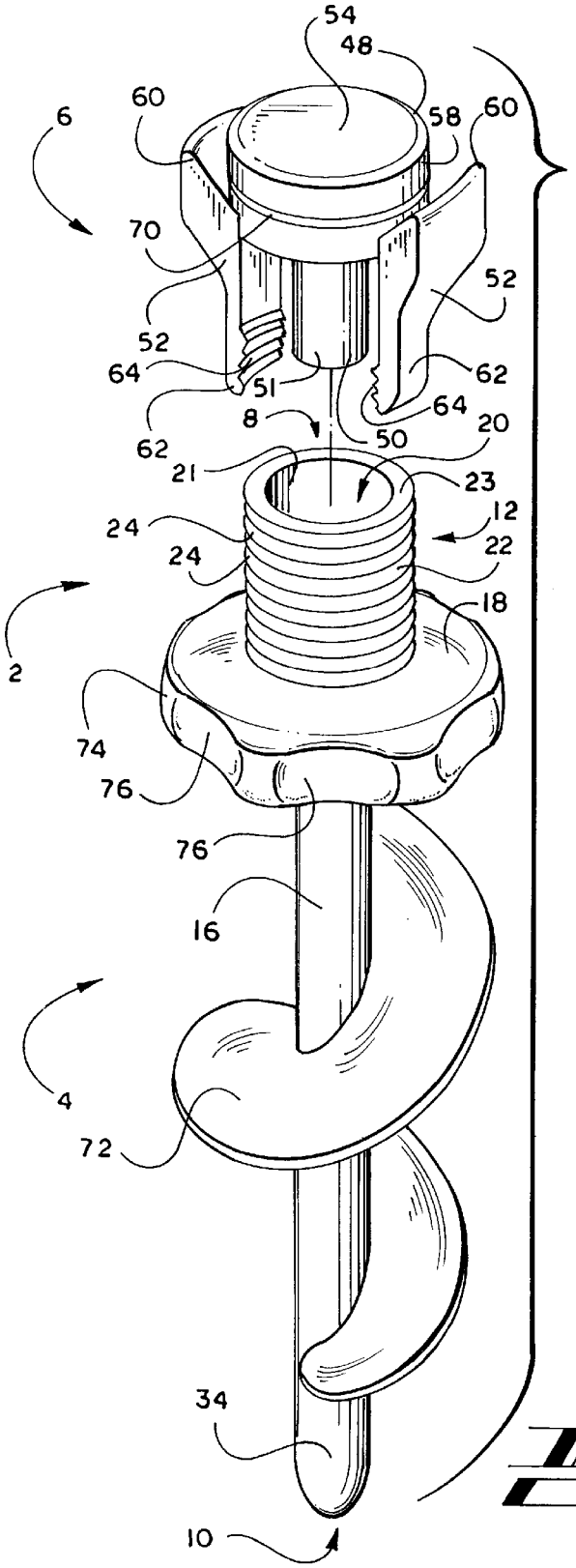
FIG. 5 is an exploded, side perspective view of another embodiment of the ground engaging restraint device made in accordance with the present invention; and, FIG. 6 is a side elevation view of the embodiment shown in FIG. 5 with a cord.

For a fuller understanding of the nature and desired objects of this invention, reference should be made to the following detailed description taken in connection with the accompanying drawings. Referring to the drawings wherein like reference numerals designate corresponding parts throughout the several figures, reference is made first to FIGS. 1 and 3. FIG. 1 of the drawings is a side perspective view of a ground engaging restraint device, generally illustrated by reference numeral 2. The ground engaging restraint device 2 comprises two interacting portions, a ground spike 4 and a clasp 6. FIG. 3 shows a side elevation view of the ground spike 4 engaging the clasp 6.

The ground spike 4 has a first end 8, a second end 10 and a longitudinal axis disposed between the first and second ends 8 and 10. At the first end 8, the ground spike 4 has an article receiver 12, which is designed to receive an article 14, such as a beach blanket, towel or other like flexible fabric or material. Extending from the receiver 12 to the second end 10, the ground spike 4 has a ground-penetrating, elongate shaft 16 which is disposed along the longitudinal axis. Disposed between the receiver 12 and the shaft 16 is a ground-engaging stop 18. Although the receiver 12 can be formed into many different shapes, a generally tubular-shaped receiver 12 is preferred.

Located within the receiver 12 is an article retaining bore 20. As shown in FIG. 2, the bore 20 is supplied to provide a cavity wherein a part of the article 14, such as a corner portion, may be placed. Preferably, the bore 20 is concentrically disposed along the longitudinal axis. Within the bore 20 is a bore surface 21 which engages the article 14. On the outside of the receiver 12, the receiver 12 has an outer receiver surface 22 and a bore rim 23. Disposed on the outer receiver surface 22 are a plurality of equally-spaced circumferential, annular notches 24. In the preferred embodiment, the notches 24 are parallel to one another. Each notch 24 has a notched surface 26 which is preferably perpendicular to the longitudinal axis of the bore 20. It is clear that the angle of the notched surface 26 to the longitudinal axis of the bore 20 may be modified and any variation or modification of this angle is included within the scope of this invention.

The stop 18 is provided to limit the depth of the ground spike 4 within the ground. This feature maintains the receiver 12 above the surface of the ground and accessible to an individual. The stop 18 has a lower surface 28 which comes into contact with the ground when the shaft 16 has reached a sufficient depth into the ground. It is conceived that the ground spike 4 can be produced without the stop 18.

Referring to the embodiment shown in FIGS. 1 and 3, the shaft 16 has a core 30 intermediate the receiver 12 and the second end 10. At one end of the shaft 16 and adjacent the lower surface 28 of the stop 18, the shaft 16 has a neck 32. Opposite the neck 32 and at the second end 10, the shaft 16 has a ground-puncturing tip 34. The tip 34 can be manufactured as a sharp point, or as in the preferred embodiment, the tip 34 is blunt and rounded. Although not required, a plurality of interconnecting webs 36, preferably four webs, protrude outwardly from the core 30 and are disposed between the neck 32 and the tip 34. The webs 36 assist the ground spike 4 by maintaining stability and resisting movement while placed within the ground. Preferably, this embodiment has four webs 36 disposed at right angles to each other. The angles between the webs 36 may be varied and all variations of these angles are included within the scope of this invention. Each web 36 has two sides 38 and an edge 40. The sides 38 are substantially planar and the edge 40 has a substantially convex first apex 42, a substantially convex second apex 44 and a substantially concave nadier 46 disposed between the first and second apices. Preferably with this embodiment, each web 36 has substantially the same shape. After the shaft 16 is inserted into the ground, the soil surrounds the webs 36 and rests against the nadiers 46 to provide additional resistance from movement within the ground.

The clasp 6 can be activated to removably engage the receiver 12 and hold the article 14 within the bore 20. Comprising the clasp 6 are a head 48, a pin 50 and a pair of arms 52. Although not required, the head 48 is generally cylindrically shaped. The head 48 has a top surface 54 for receiving and transmitting a force, while the clasp 6 is engaged to the ground spike 4, sufficient to cause the shaft 16 to penetrate the ground. In the preferred embodiment, the top surface 54 is substantially planar. On the opposite side of the top surface 54, the head 48 has a bottom surface 56. While in use, the bottom surface 56 removably engages the article 14. Depending from the bottom surface 56, the pin 50 removably engages and anchors the article 14 within the bore 20. The pin 50 has a pin surface 51, and as the pin 50 is inserted into the bore 20, the pin surface 51 engages and presses the article 14 into frictional engagement with the bore surface 21, retaining the article 14 within the bore 20.

Between the top and bottom surfaces 54 and 56, the head 48 has a circumferential head surface 58. Each arm 52 pivotingly depends from the circumferential head surface 58 and has two ends. A gripping end 60 is at one end of each arm 53 for manually manipulating the arm and a mating end 62 is at the other end to engage the receiver 12. The mating end 62 is biased toward the pin 50 as the clasp 6 is formed. In the preferred embodiment, the clasp 6 is made of a resilient plastic, which enables the arms 53 to be manually pivoted and after release, return to their original formation position. The mating end 62 has a plurality of teeth 64 extending outwardly from the mating end 62 to removably and matingly engage the notches 24 of the receiver 12. Each tooth 64 has a tooth surface 66 which engagingly mates with the notched surface 26 and secures the clasp 6 to the receiver 12 until released.

Alternate means exist to removably secure the clasp 6 to the ground spike 4. The circumferential head surface 58 and the clasp 6 can be designed with mating screw threads. A peg could be used to insert through an orifice in the clasp 6 into a hole within the ground spike 4. The clasp 6 could be strapped to the ground spike 4. Also, the pin 50 can be designed as a wedge or a frusto conical plug to frictionally engage the bore 20.

In addition to the arms 52 depending from the circumferential head surface 58, an alternate means also exists. The arms 52 can be mounted to the circumferential head surface 58 by a hinge with a biasing means, such as a spring, to bias the mating end toward the pin 50.

To prevent the accidental proximal separation of the ground spike 4 from the clasp 6, the ground engaging restraint device 2 has a cord 68. The circumferential head surface has a circumferential groove 70. The cord 68 is mounted within the groove 70 at one end and attached to the neck 32 at the other end.

Another use for the cord 68 is for the purpose of securing articles which are not flexible materials. Frequently, at the beach or other places, the user may want to secure an object like a lightweight beach or lawn chair. Obviously, such an object cannot be secured like a towel. Therefore, the user would wrap the cord 68 around a leg or other support structure and then place the head 48 onto the first end 8 of the ground spike, thereby effecting a secure holding arrangement between the ground spike 4 and the article desired to be held.

In the preferred embodiment and while the ground spike 4 and the clasp 6 are engaged, the head 48, the pin 50, the receiver 12, the bore 20, the stop 18 and the shaft 16 are co-axial.

Figure 6:
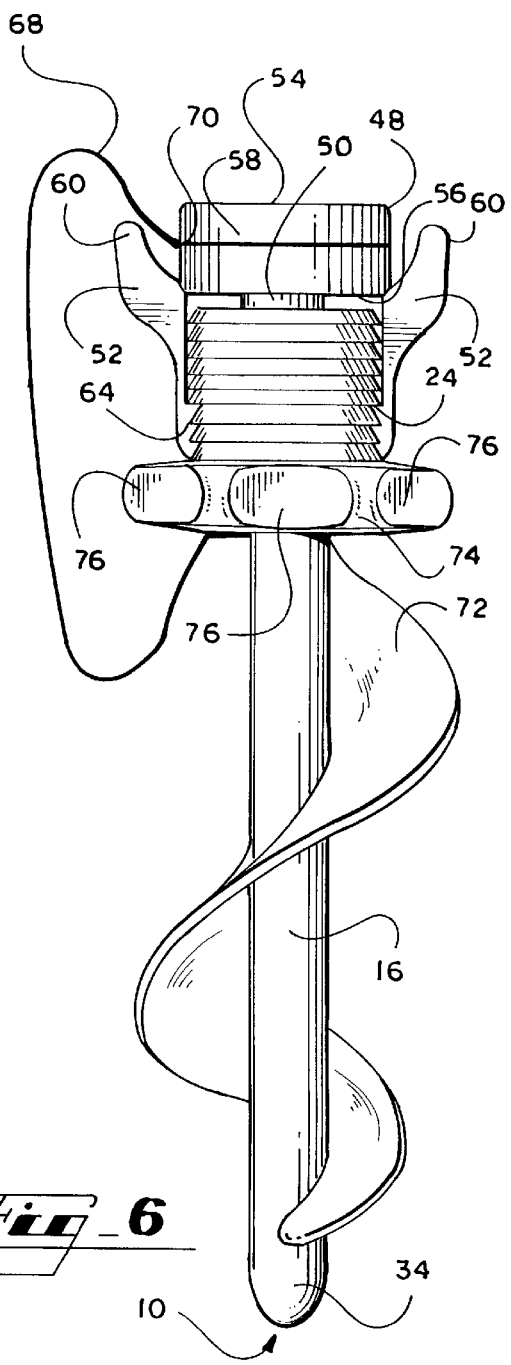

Referring now to FIGS. 5 and 6, another embodiment of the ground engaging restraint device 2 made in accordance with the present invention is shown. In this embodiment, the ground-penetrating, elongate shaft 16, which is disposed along the longitudinal axis, has a helical blade 72 fixed concentrically about the shaft 16. The blade 72 originates proximate the second end 10, winds around the shaft 16 in a spiral manner similar to a screw thread or an auger, and terminates proximate the receiver 12. The tip 34 of the shaft 16 is inserted into the ground until the blade 72 contacts the ground. By rotating the ground spike 4, the blade 72 screws the shaft 16 into the ground and provides significant resistance to movement or withdrawal from the ground. To assist in rotating the ground spike 4, the stop 18 is modified from the previously described embodiment. The stop 18 has a stop edge 74 around the circumference of the stop 18. A plurality of equal-distantly space thumb surfaces 76 are disposed on the stop edge 74. The thumb surfaces 76 can be substantially planar or, preferably, concave in shape to provide a better gripping surface. The features of the clasp 6 and the receiver 12 previously described likewise are applicable to this embodiment.

In use, a portion of the article 14 is placed over the bore 20. The clasp 6 is then placed on the receiver 12 so that the pin 50 aligns with and inserts into the bore 20 with the article 14 between the bore surface 21 and the pin surface 51. Once the article 14 is securely disposed between the bore 20 and the pin 50, the clasp 6 is released, allowing the teeth 64 to engage the notches 24 and secure the clasp 6 to the receiver 12. It is readily apparent that more than a single article 14 may be secured within bore 20.

Various modifications may be made of the invention without departing from the scope thereof and it is desired, therefore, that only such limitations shall be placed thereon as are imposed by the prior art and which are set forth in the appended claims.

What is claimed is:

1. A ground engaging restraint device for anchoring an article made of a flexible fabric or other like material to the ground, comprising:

a ground spike having a first end, a second end and a longitudinal axis disposed between the first and second ends;

an article receiver at the first end of the ground spike, the receiver having an article retaining bore, the bore having a bore surface and a bore rim;

a ground-penetrating, elongate shaft depending from the receiver and extending to the second end along the longitudinal axis, the shaft having a core, a neck adjacent the receiver, a ground-puncturing tip at the second end and a plurality of interconnected webs protruding outwardly from the core and disposed between the neck and the tip, each web having opposing sides and an edge, the edge having a substantially convex first apex, a substantially convex second apex and a substantially concave nadier disposed between the first and second apices, whereby the ground envelopes the nadier and further anchors the ground spike in the ground by increasing removal resistance along the edge;

a clasp for removably engaging the receiver and the article to hold the article within the bore, the clasp having a head;

a top surface of the head for receiving and transmitting a force to the ground spike sufficient to cause the shaft to penetrate the ground;

a bottom surface of the head to removably engage the article and maintain the article in contact with the rim bore;

first means associated with the clasp activatable to removably secure the clasp to the ground spike; and a pin depending from the bottom surface of the head for removably pressing the article into the bore and for removably engaging and anchoring the article within the bore, the pin having a pin surface, and the pin surface and the bore surface acting in concert to frictionally engage and retain the article within the bore.

2. An apparatus as claimed in claim 1, further comprising a ground-engaging stop disposed intermediate the receiver and the shaft.

3. A ground engaging restraint device for anchoring an article made of a flexible fabric or other like material to the ground, comprising:

a ground spike having a first end, a second end and a longitudinal axis disposed between the first and second ends;

an article receiver at the first end of the ground spike, the receiver having an article retaining bore and an outer receiver surface, the bore having a bore surface and a bore rim, the outer receiver surface having at least one receiver notch;

a ground-penetrating, elongate shaft depending from the receiver and extending to the second end along the longitudinal axis;

a clasp for removably engaging the receiver and the article to hold the article within the bore, the clasp having a head, the head having a circumferential head surface;

a top surface of the head for receiving and transmitting a force to the ground spike sufficient to cause the shaft to penetrate the ground;

a bottom surface of the head to removably engage the article and maintain the article in contact with the rim bore;

at least one arm comprising a gripping end for manually manipulating the arm and a mating end having at least one tooth extending outwardly from the mating end to removably and matingly engage the receiver notch, and second means for pivotingly engaging the arm to the circumferential head surface and biasing the mating end toward the pin; and a pin depending from the bottom surface of the head for removably pressing the article into the bore and for removably engaging and anchoring the article within the bore, the pin having a pin surface, and the pin surface and the bore surface acting in concert to frictionally engage and retain the article within the bore.

4. An apparatus as claimed in claim 2, wherein the head is generally cylindrically shaped.

5. An apparatus as claimed in claim 2, wherein the receiver has a generally tubular shape.

6. An apparatus as claimed in claim 2, wherein second means comprises the arm pivotingly and resiliently depending from the circumferential head surface.

7. An apparatus as claimed in claim 2, wherein the first means comprises:

the receiver having an outer receiver surface, the outer receiver surface having at least one receiver notch, the head having a circumferential head surface, and further comprises at least one arm comprising a gripping end for manually manipulating the arm and a mating end having at least one tooth extending outwardly from the mating end to removably and matingly engage the receiver notch, and second means for pivotingly engaging the arm to the circumferential head surface and biasing the mating end toward the pin.

8. An apparatus as claimed in claim 7, wherein the second means comprises the arm pivotally and resiliently depending from the circumferential head surface.

9. An apparatus as claimed in claim 1, wherein the first means comprises:

the receiver having an outer receiver surface, the outer receiver surface having at least one receiver notch, the head having a circumferential head surface, and further comprising at least one arm comprising a gripping end for manually manipulating the arm and a mating end having at least one tooth extending outwardly from the mating end to removably and matingly engage the receiver notch, and second means for pivotingly engaging the arm to the circumferential head surface and biasing the mating end toward the pin.

10. An apparatus as claimed in claim 9, wherein the second means comprises the arm pivotally and resiliently depending from the circumferential head surface.

11. An apparatus as claimed in claim 2, wherein the ground spike and the clasp are made of resilient plastic.

12. An apparatus as claimed in claim 2, further comprising a cord attached to the ground spike at one end and attached to the clasp at the other end.

13. An apparatus as claimed in claim 2, wherein the top surface of the head is substantially planar.

14. An apparatus as claimed in claim 2, further comprising a helical blade fixed concentrically about the shaft originating proximate the second end and terminating proximate the receiver.

15. An apparatus as claimed in claim 14, further comprising a ground-engaging stop disposed intermediate the receiver and the shaft.

16. An apparatus as claimed in claim 15, wherein the stop has a stop edge and the stop edge has at least one thumb surface.

17. An apparatus as claimed in claim 14, wherein the shaft has a ground-puncturing tip at the second end.

18. An apparatus as claimed in claim 16, wherein the shaft has a ground-puncturing tip at the second end.

19. A ground engaging restraint device for anchoring an article comprising:

a ground spike portion having a first end, a second end and a longitudinal axis disposed between the first and second ends, a generally tubular shaped receiver at the first end, the receiver having an article retaining bore and an outer receiver surface, the bore having a bore surface and a bore rim, the outer receiver surface having at least one receiver notch, a ground-penetrating, elongate shaft depending from the receiver to the second end along the longitudinal axis, a ground-engaging stop disposed intermediate the receiver and the shaft, the stop having a lower surface and the shaft having a core, a neck adjacent the lower surface of the stop, a ground-puncturing tip at the second end, a plurality of interconnected webs extending outwardly from the core and disposed between the neck and the tip, each web having substantially planar, opposing sides and an edge, the edge having a substantially convex first apex, a substantially convex second apex and a substantially concave nadier disposed between the first and second apices, a clasp portion for removably engaging the receiver to hold the article within the bore, the clasp having a generally cylindrically shaped head, the head having a circumferential head surface, the circumferential head surface having a circumferential groove, a substantially planar top surface of the head for receiving and transmitting a force to the ground spike sufficient to cause the shaft to penetrate the ground, a bottom surface of the head to removably engage the article and maintain the article in contact with the rim bore, a pin depending from the bottom surface of the head for engaging the bore, at least one arm comprising a gripping end for manually manipulating the arm and a mating end having at least one tooth protruding outwardly from the mating end to removably and matingly engage the receiver notch, the arm pivotingly depending from the circumferential head surface with the mating end biased toward the pin, and a cord mounted within the groove at one end and attached to the neck at the other end.

20. An apparatus as claimed in claim 1, wherein the ground spike and the clasp are made of resilient plastic.

21. A ground engaging restraint device for anchoring an article comprising:

a ground spike portion having a first end, a second end and a longitudinal axis disposed between the first and second ends, a generally tubular shaped receiver at the first end, the receiver having an article retaining bore and an outer receiver surface, the bore having a bore surface and a bore rim, the outer receiver surface having at least one receiver notch, a ground-penetrating, elongate shaft depending from the receiver to the second end along the longitudinal axis, a helical blade fixed concentrically about the shaft originating proximate the second end and terminating proximate the receiver, a ground-engaging stop disposed intermediate the receiver and the shaft, the stop having a lower surface and a stop edge, the stop edge having at least one thumb surface, a ground-puncturing tip at the second end, a clasp portion for removably engaging the receiver to hold the article within the bore, the clasp having a generally cylindrically shaped head, the head having a circumferential head surface, the circumferential head surface having a circumferential groove, a substantially planar top surface of the head for receiving and transmitting a force to the ground spike sufficient to cause the shaft to penetrate the ground, a bottom surface of the head to removably engage the article and maintain the article in contact with the rim bore, a pin depending from the bottom surface of the head for engaging the bore, at least one arm comprising a gripping end for manually manipulating the arm and a mating end having at least one tooth protruding outwardly from the mating end to removably and matingly engage the receiver notch, the arm pivotingly depending from the circumferential head surface with the mating end biased toward the pin, and a cord mounted within the groove at one end and attached to the neck at the other end.

22. An apparatus as claimed in claim 21, wherein the ground spike and the clasp are made of resilient plastic.

* * * * *